US008346131B2

(12) United States Patent
Kim

(10) Patent No.: US 8,346,131 B2
(45) Date of Patent: Jan. 1, 2013

(54) IMAGE FORMING APPARATUS HAVING A POWER TRANSMISSION DEVICE

(75) Inventor: Sung Han Kim, Suwon-Si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 458 days.

(21) Appl. No.: 12/642,260

(22) Filed: Dec. 18, 2009

(65) Prior Publication Data

US 2010/0178079 A1 Jul. 15, 2010

(30) Foreign Application Priority Data

Jan. 14, 2009 (KR) ..... 10-2009-0002922

(51) Int. Cl.
*G03G 15/00* (2006.01)

(52) U.S. Cl. ..... 399/167; 310/103

(58) Field of Classification Search ..... 399/167; 310/103–105, 80; 74/DIG. 4; 464/29
See application file for complete search history.

(56) References Cited

U.S. PATENT DOCUMENTS

| | | | | |
|---|---|---|---|---|
| 5,126,800 | A * | 6/1992 | Shishido et al. | 399/167 |
| 5,268,718 | A * | 12/1993 | Maeda et al. | |
| 5,319,418 | A * | 6/1994 | Fujimoto et al. | 399/167 |
| 5,569,967 | A * | 10/1996 | Rode | 310/103 |
| 6,411,001 | B1 * | 6/2002 | Henderson et al. | 310/103 |
| 2005/0028628 | A1 * | 2/2005 | Liue | 74/DIG. 4 |
| 2006/0091748 | A1 * | 5/2006 | Yoda et al. | |
| 2007/0065181 | A1 * | 3/2007 | Ookushi et al. | |

FOREIGN PATENT DOCUMENTS

| | | | |
|---|---|---|---|
| JP | 61132069 | A * | 6/1986 |
| JP | 61180569 | A * | 8/1986 |
| JP | 63245247 | A * | 10/1988 |
| JP | 63277465 | A * | 11/1988 |
| JP | 01034172 | A * | 2/1989 |
| JP | 01097162 | A * | 4/1989 |
| JP | 04266654 | A * | 9/1992 |
| JP | 05231517 | A * | 9/1993 |
| JP | 06014524 | A * | 1/1994 |
| JP | 09056146 | A * | 2/1997 |
| JP | 2003-337472 | | 11/2003 |
| JP | 2004-018142 | | 1/2004 |
| JP | 2005315370 | A * | 11/2005 |
| JP | 2008235452 | A * | 10/2008 |

OTHER PUBLICATIONS

English language abstract of JP 2003-337472, published Nov. 28, 2003.
Machine English language translation of JP 2003-337472, published Nov. 28, 2003.
English language abstract of JP 2004-018142, published Jan. 22, 2004.
Machine English language translation of JP 2004-018142, published Jan. 22, 2004.

* cited by examiner

*Primary Examiner* — Susan Lee
(74) *Attorney, Agent, or Firm* — Stanzione & Kim, LLP

(57) ABSTRACT

Disclosed is an image forming apparatus including one or more rotary members rotatably arranged and a power transmission device operable to receive a rotary force and to transmit the received rotary force to one or more of the rotary members. The power transmission device transmits the rotary force to the rotary member(s) in a non-contact manner such that a vibration of one rotary member is not transmitted through the power transmission device to another component of the image forming apparatus.

11 Claims, 11 Drawing Sheets

IMAGE FORMING APPARATUS HAVING A POWER TRANSMISSION DEVICE

CROSS-REFERENCE TO RELATED APPLICATION

This application claims the benefit of Korean Patent Application No. 10-2009-0002922, filed on Jan. 14, 2009 in the Korean Intellectual Property Office, the disclosure of which is incorporated herein by reference.

TECHNICAL FIELD

The present disclosure relate generally to an image forming apparatus having a power transmission device to transmit rotary force to rotary members thereof.

BACKGROUND OF RELATED ART

Image forming apparatuses are apparatuses that form an image on print media, e.g., sheets of paper, according to an input image signal. Examples of image forming apparatuses may include a printer, a copier, a fax machine and so-called a multi-functional peripheral products that combine some of the functionalities of the afore-mentioned.

In order to accomplish the formation of images on print media, an image forming apparatus includes a number of sub units and components accommodated in its main body that defines the overall external appearance of the image forming apparatus. Such sub units and components may generally include, for example, a print media storage unit for storing print media, a pickup unit for picking up the print media from the print media storage unit typically one medium at a time, a feeding unit for feeding the picked up print media further along the media delivery path, a developing unit for forming a. visible image using developer, e.g., toner, on the print medium, a fusing unit for fusing or fixing the developer image on the print medium and an exit unit for discharging the print medium having the developer image thereon to the outside of the main body.

Some of the above units and components may include one or more rotary members. For example, the developing unit may include a number of rotary members, the rotational operation of each of which is involved in the formation of the developer image on the print media. These rotary members of a developing unit may include, for example, a photoconductor provided with a photosensitive surface, on which an electrostatic latent image is formed by a light exposure, a charging roller for charging the photoconductor, a developing body for supplying the developer to the photoconductor to develop the electrostatic latent image formed thereon into a visible image and a supply roller for supplying the developer to the developing body.

Such developing unit may also include additional rotary members, which may include, for example, a scatter prevention member, which arranged to oppose and to be spaced apart from the photoconductor, and which operates to produce an air current for counteracting the air current resulting from the rotation of the photoconductor so as to prevent the developer scattered from the photoconductor from contaminating the print media.

The scatter prevention member may be rotated at a high speed by the rotary force transmitted from the photoconductor through a power transmission device that includes a gear or a train of gears. When the scatter prevention member is rotated at such a high speed to generate the air current, the scatter prevention member can generate or experience vibration. Such vibration may be transmitted to the photoconductor through the power transmission device, and may adversely impact the image quality, for example, horizontal stripes may develop in the resulting image.

SUMMARY OF DISCLOSURE

In accordance with one aspect of the present disclosure, there may be provided an image forming apparatus that may include a rotary member and a power transmission device. The rotary member may be rotatably arranged in the image forming apparatus. The power transmission device may be coupled to the rotary member, and may be configured to receive a rotary force from a rotary force source and to transmit the received rotary force to the rotary member in a non-contact manner.

The rotary member may comprise at least one selected from the group consisting of a photoconductor configured to carry thereon a visible image, a charging device configured to charge the photoconductor, a developing body configured to supply developer to the photoconductor to thereby form the visible image on the photoconductor, a supply device configured to supply the developer to the developing body and a scatter prevention member arranged to oppose and to be spaced apart from the photoconductor and configured to produce an air current in a first direction opposite to a second direction of air current produced by the photoconductor.

The power transmission device may include a first rotary body and a second rotary body. The first, rotary body may be rotated by the rotary force received from a driving motor. The second rotary body may be spaced apart from the first rotary body, and may be rotatable by the rotary force transmitted from the first rotary body in the non-contact manner. The second body may be coupled to the rotary member so as to rotate the rotary member.

The first rotary body may include a gear part through which to receive the rotary force from the driving motor and a power transmission part configured to transmit the received rotary force to the second rotary body in the non-contact manner.

The second rotary body may be rotated by the rotary force transmitted from the first rotary body through magnetic force.

N-pole magnets and S-pole magnets may be arranged alternately on outer circumferential surfaces of the first rotary body and the second rotary body.

One or more boundary lines between the N-pole magnets and the S-pole magnets may be tilted at an angle with respect to rotational axes of the first rotary body and the second rotary body.

According to another aspect of the present disclosure, an image forming apparatus may be provided to include a rotary member and a power transmission device. The rotary member may be rotatably arranged in the image forming apparatus. The power transmission device may be coupled to the rotary member, and may be configured to receive a rotary force from a rotary force source and to transmit the received rotary force to the rotary member through a magnetic force.

According to yet another aspect of the present disclosure, a mechanism for transmitting a rotational force may be provided to include a driving rotational body and a driven rotational body. The driving rotational body may be configured to rotate. The driven rotational body may be arranged to be spaced apart from the driving rotational body, and may be rotatable by the rotational force received from the driving rotational body through a magnetic coupling with the driving rotational body.

Each of the driving rotational body and the driven rotational body may have one or more N-pole permanent magnets and one or more S-pole permanent magnets alternatingly arranged on respective outer circumferential surfaces thereof.

A first boundary between two adjacent ones of the one or more N-pole permanent magnets and the one or more S-pole permanent magnets arranged on the driving rotational body may not be parallel to a second boundary between two adjacent ones of the one or more N-pole permanent magnets and the one or more S-pole permanent magnets arranged on the driven rotational body.

The respective rotational axes of the driving rotational body and the driven rotational body may be substantially parallel to each other. At least one boundary between two adjacent ones of the one or more N-pole permanent magnets and the one or more S-pole permanent magnets arranged on the driving rotational body and the driven rotational body may not be parallel to the respective rotational axes of the driving rotational body and the driven rotational body.

Alternatively, at least one boundary between two adjacent ones of the one or more N-pole permanent magnets and the one or more S-pole permanent magnets arranged on the driving rotational body and the driven rotational body may not be parallel to at least one of respective rotational axes of the driving rotational body and the driven rotational body.

The driven rotational body may comprise a first driven rotational body and a second driven rotational body each arranged to be spaced apart from the driving rotational body, and, each may be configured to be rotationally driven by the rotational force received from the driving rotational body through the magnetic coupling with the driving rotational body.

The driving rotational body and the driven rotational boy may have respective diameters different from each other.

The driving rotational body may comprise a gear in engagement with a source of the rotational force.

The mechanism may further comprise a rotational member coupled to the driven rotational body so as to rotate together with the driven rotational body.

BRIEF DESCRIPTION OF THE DRAWINGS

Various features and advantages of the present disclosure will become apparent and more readily appreciated from the following description of several embodiments thereof, taken in conjunction with the accompanying drawings, of which.

DETAILED DESCRIPTION OF SEVERAL EMBODIMENTS

Figure 1:
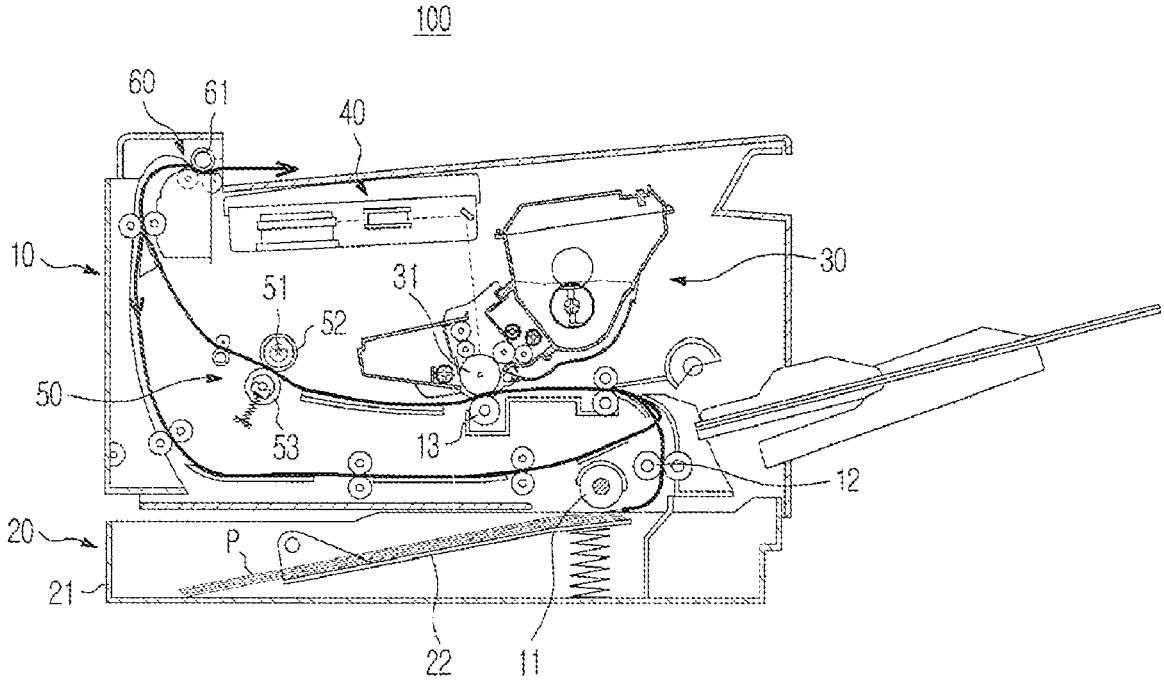
FIG. 1 is a cross-sectional view schematically illustrating the configuration of an image forming apparatus in accordance with an, embodiment of the present disclosure.

Reference will now be made in detail to several embodiments of the present disclosure, examples of which are illustrated in the accompanying drawings, wherein like reference numerals refer to the like elements throughout.

Shown in FIG. 1 is an image forming apparatus 100 in accordance with an embodiment, which may include a main body 10 forming the overall external appearance of the image forming apparatus 100, a print media storage unit 20 configured to store and to supply print media P for use in the image forming apparatus 100, a developing unit. 30 for forming a visible image using developer on the print media P supplied from the print media storage unit 20, an exposure unit 40 that exposes a photoconductor 31 of the developing unit 30 with light thereby forming an electrostatic latent image on the photoconductor 31, a fusing unit 50 configured to fuse the visible developer image onto the print media P and an exit unit 60 for discharging the print media P, upon completion of the formation the image thereon, to the outside of the main body 10.

The print media storage unit 20 may include a print media cassette 21, which may be in some embodiments, detachably received in the main body 10, for example, as a sliding drawer type, and which may include a knock-up plate 22 for holing thereon the print media P.

The pick-up roller 11, which may be arranged in the main body 10, may pick up the print media P from the knock-up plate 22 one medium of at a time,. The feed rollers 12 may be operable to feed the print media P picked up by the pick-up roller 11 further along the media delivery path toward the developing unit 30.

The exposure unit 40 may irradiate light, which may be modulated with or otherwise include image information, onto the photoconductor 31, thereby forming an electrostatic latent image on the photoconductor 31.

The fusing unit 50 may apply heat and pressure to thereby fuses the visible image onto the print media P. To that end, the fusing unit 50 may include a heating roller 52 provided with a heater 51 and a pressure roller 53 that is arranged to press the print media P against the heating roller 52. A print medium P passing through between the heating roller 52 and the pressure roller 53 is subjected to the heat and pressure, resulting in the developer being carried on the print media P to melt or be fused onto the print medium P.

The exit unit 60 may include exit rollers 61, which may operate sequentially to discharge the print medium P, which has passed through the fusing unit 50, to the outside of the main body 10.

Figure 2:
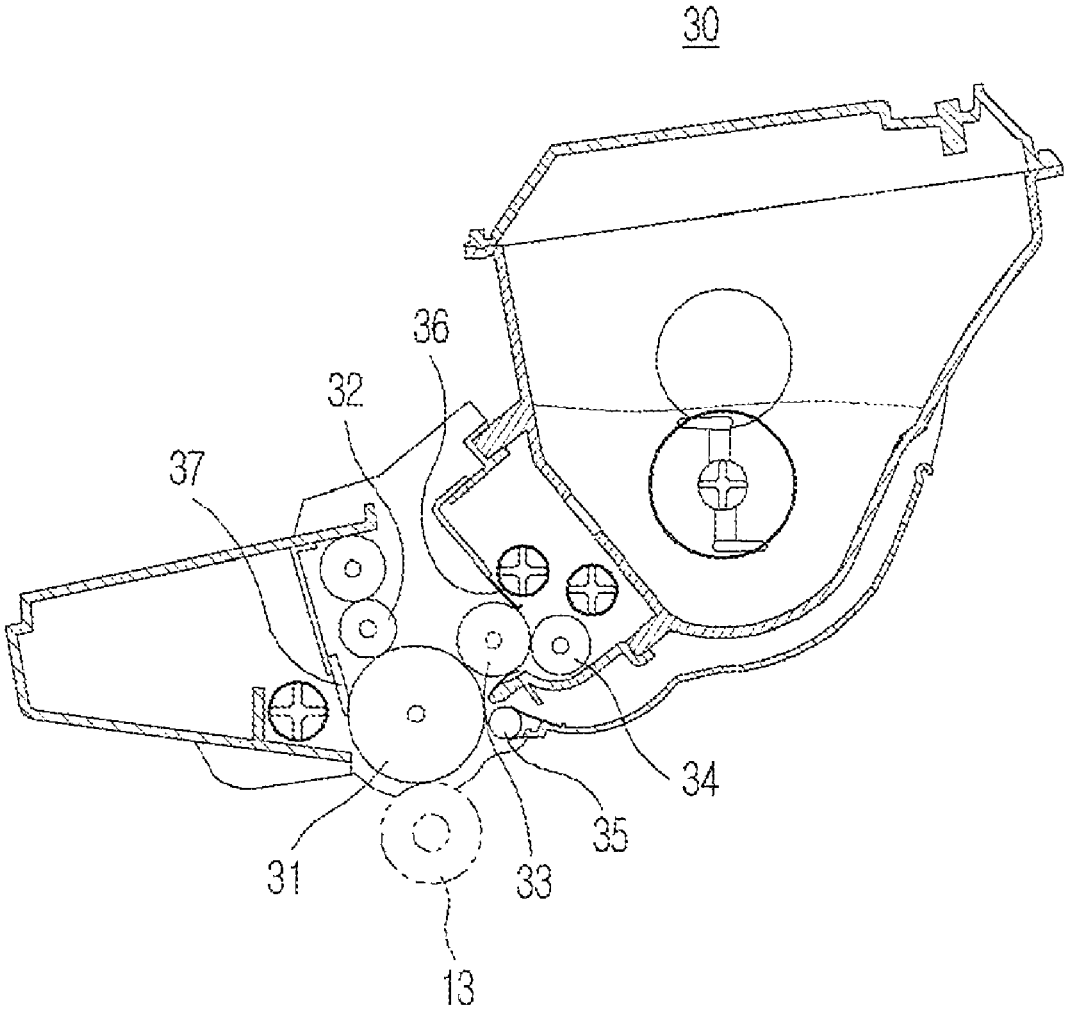
FIG. 2 is a cross-sectional view of a developing device according to an embodiment of the present disclosure.

The developing unit 30 may form the visible image on the print media supplied from the print media storage unit 20 using developer. To that end, and as shown in FIG. 2, a plurality of rotary members may be rotatably arranged in the developing unit 30 Such rotary members according to an embodiment may include a photoconductor 31, which may in turn include an image carrier surface on which to support an electrostatic latent image that results from exposure to light from the exposure unit 40 and the visible developer image resulting from development of the electrostatic latent image with developer, a charging roller 32 serving as a charging device to charge the photoconductor 31, a developing body 33 for supplying the developer to the photoconductor 31 to thereby develop the electrostatic latent image formed on the photoconductor 31 into the visible developer image, a supply roller 34 serving as a supply device to supply the developer to the developing body 33 and a scatter prevention member 35, which is arranged to oppose, and to be spaced apart from, the photoconductor 31, and which may be operable to produce an air current in a direction opposite to the direction of the air current resulting from the rotation of the photoconductor 31 so as to prevent the developer scattered from the photoconductor 31 from migrating to and thus contaminating the print media P.

According to an embodiment, the developing unit 30 may further include a; regulation member 36 arranged to regulate the thickness of the developer on the developing body 33 to a uniform thickness and a cleaning blade 37 for removing the developer remaining residual on the photoconductor 31 after a formation of an image. According to an embodiment, a transfer roller 13 may be arranged in the main body separately from the developing unit 30, and may serve as a transfer device to press the print media P against the photoconductor 31 to transfer the visible developer image from the photoconductor 31 to the print media P.

The image forming apparatus 100 in accordance with an embodiment may further include a driving motor (not shown) for generating the rotary force for rotationally driving the above-described rotary members and a power transmission device 70 (shown in FIG. 3) to convey the rotary force from the driving motor to at least one of the rotary members.

Referring to FIGS. 3A-3F, the power transmission devices 70A-70F, the first rotary bodies 71A-71F, and the second rotary bodies 72A-72F are collectively referred as the power transmission devices 70, the first rotary bodies 71, and the second rotary bodies 72, and the driving motors 80A-80F are collectively referred as the driving motor 80. The power transmission device 70 according to an embodiment may transmit the rotary force generated by a driving power source, e.g., a driving motor, to the rotary members in a non-contact manner, that is, without making a physical contact. Such non-contact transmission of the rotary force may reduce the lowering of the image quality that may otherwise result due to the transfer of the vibration in one rotary member to another.

Figure 3A:
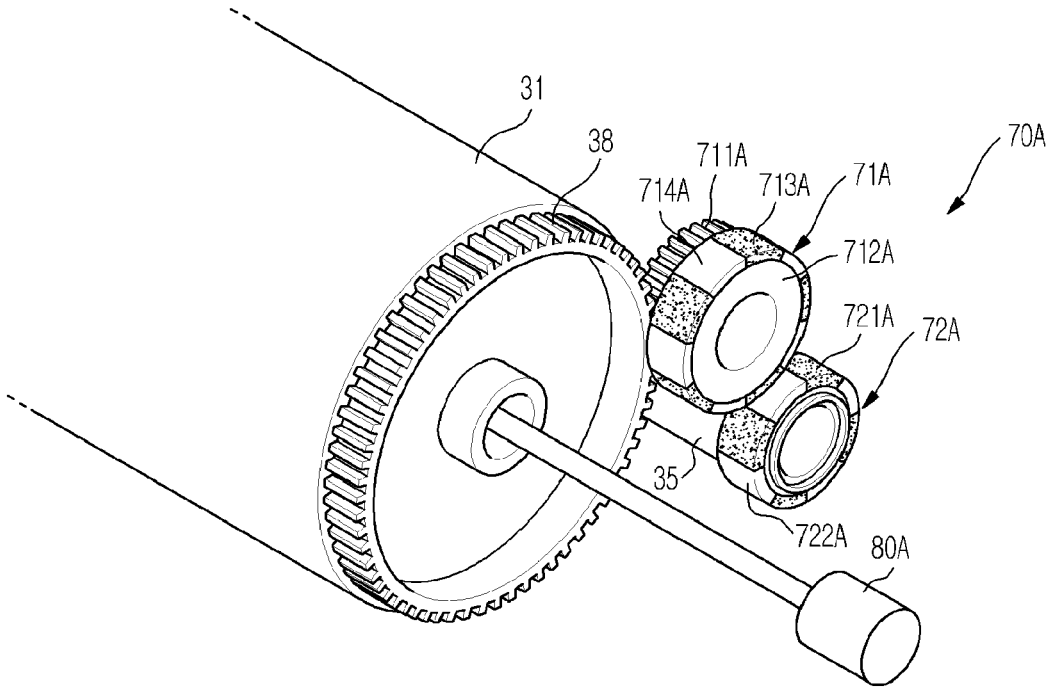
FIGS. 3A-3F illustrate perspective views of a power transmission device according to various embodiments of the present disclosure.
Figure 3B:
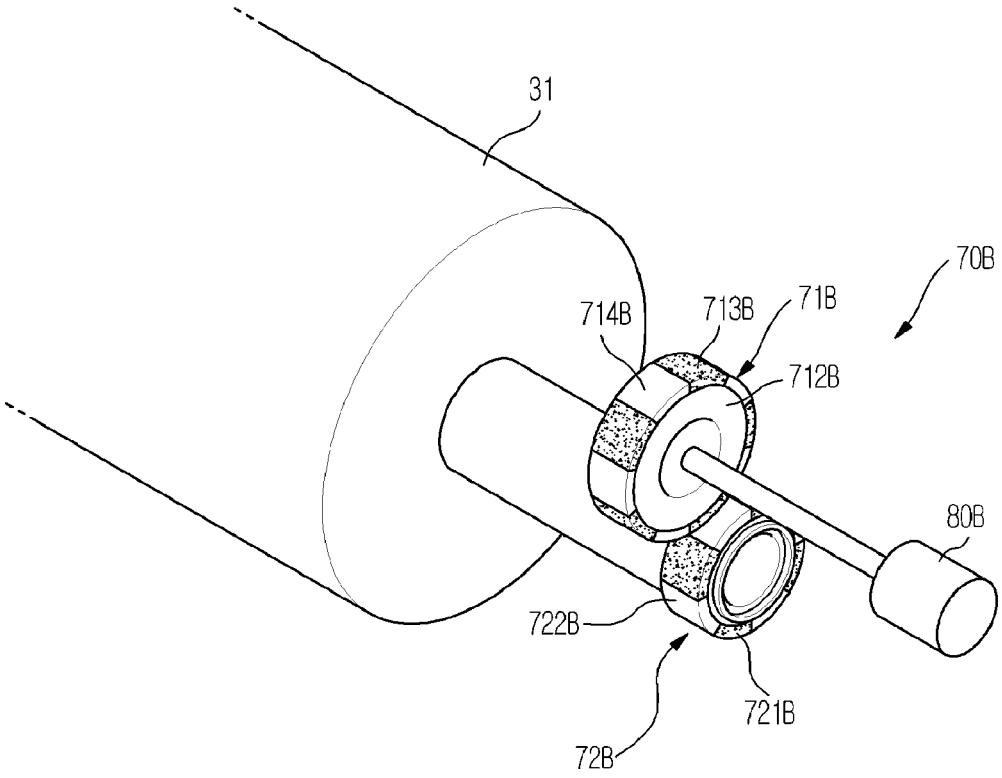
Figure 3C:
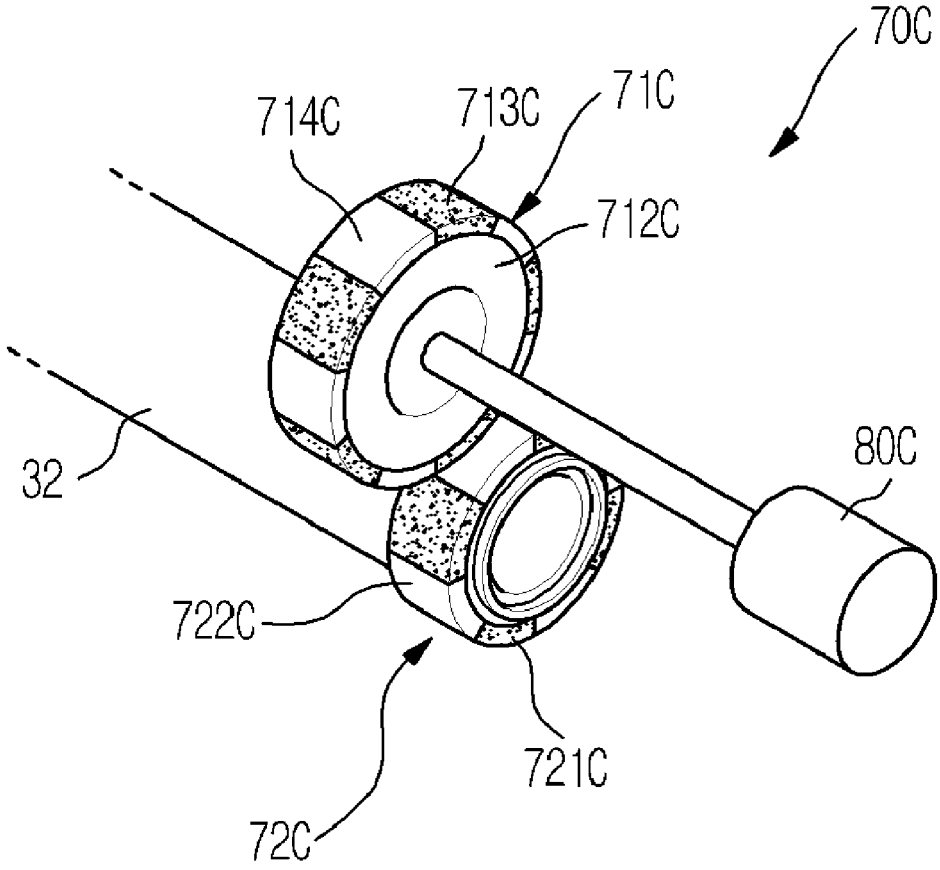
Figure 3D:
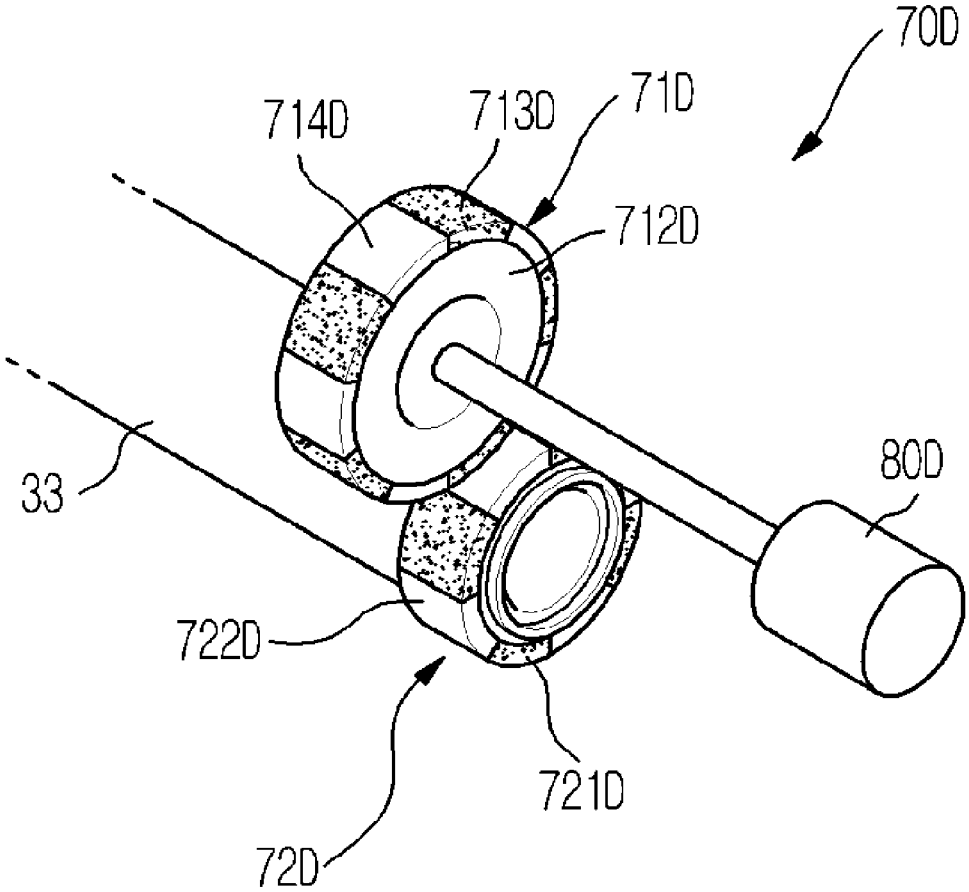
Figure 3E:
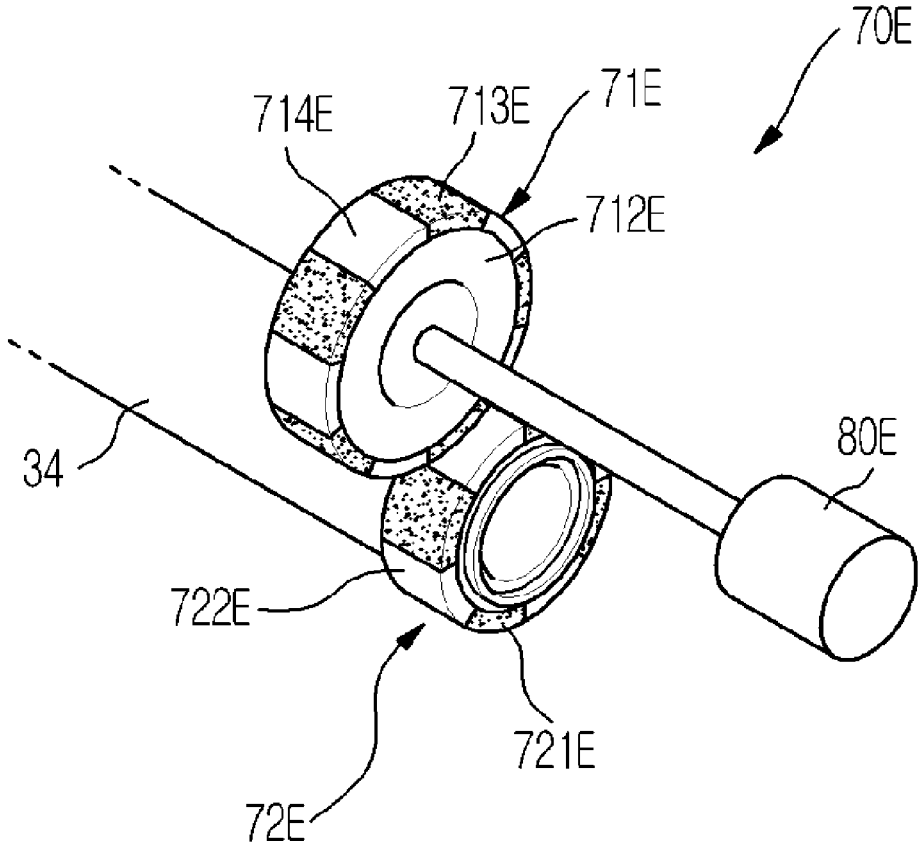
Figure 3F:
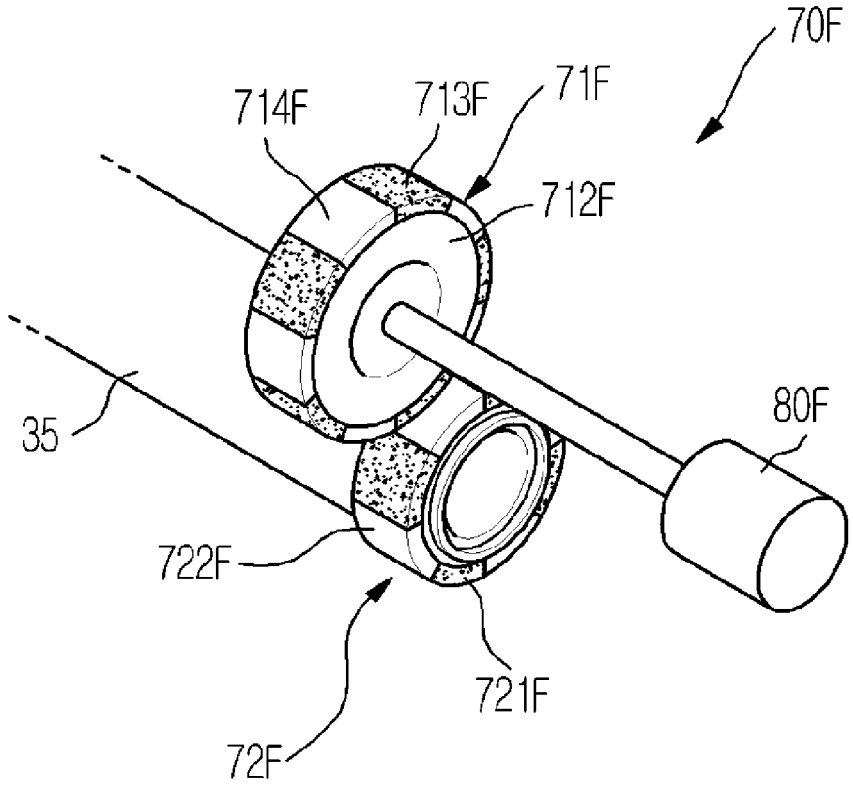

According to an embodiment of the present disclosure, the power transmission device 70 may include a first rotary body 71 that is rotated by the rotary force received from the driving motor 80 and a second rotary body 72, which is spaced apart from, and thus physically separated from, the first rotary body 71, and which is driven to rotate by the rotary force received from the first rotary body 71 in the non-contact manner. According to an embodiment, the second rotary body 72 may be rotated by the rotary force transmitted from the first rotary body 71 through a magnetic force. Specifically, the first rotary body 71 receives the rotary force from the driving motor 80 and a power transmission part 712 is arranged to oppose, and to be spaced apart from, the second rotary body 72. As illustrated in FIG. 3A, the first rotary body 71A according to one embodiment may include a gear part 711A having gear, teeth through which to receive the rotary force from the driving motor 80A.

According to an embodiment illustrated in FIG. 3A, the first rotary body 71A may be rotated by the rotary force transmitted from the driving motor 80A through the photoconductor 31 while the scatter prevention member 35 as one example of a rotary member may be coupled to the second rotary body 72A. The photoconductor 31 may include a gear member 38 arranged on one end thereof. The gear member 38 may be configured so as to engage with the gear part 711A of the first rotary body 71A. Thus, the rotary force of the driving motor 80A may be transmitted to the first rotary body 71A through the photoconductor 31 and through the engagement of the gear member 38 and the gear part 711A. According to embodiments illustrated in FIGS. 3B-3F, the first rotary bodies 71B-71F may receive the rotary force directly from the driving motors 80B-80F. Further, in the embodiments illustrated in FIGS. 3B-3F, the power transmission devices 70B-80F transmit the rotary force from the driving motors 80B-80F to the photoconductor 31, the charging roller 32, the developing body 33, the supply roller 34, and the scatter prevention member 35, respectively. With such configuration described above, even when vibration occurs in the scatter prevention member 35 during a high-speed rotational operation thereof, and even when such vibration may be transmitted to the second rotary body 72 due to the coupling of the scatter prevention member 35 to the second rotary body 72, the vibration may nevertheless not transmitted to the first rotary body 71 due to the fact that the first and second rotary bodies 71 and 72 are physically separated from each other. Accordingly, it is possible to avoid the defects in the resulting image, e.g., horizontal stripes, that would otherwise have resulted had the vibration been transmitted to the photoconductor 31.

Figure 4:
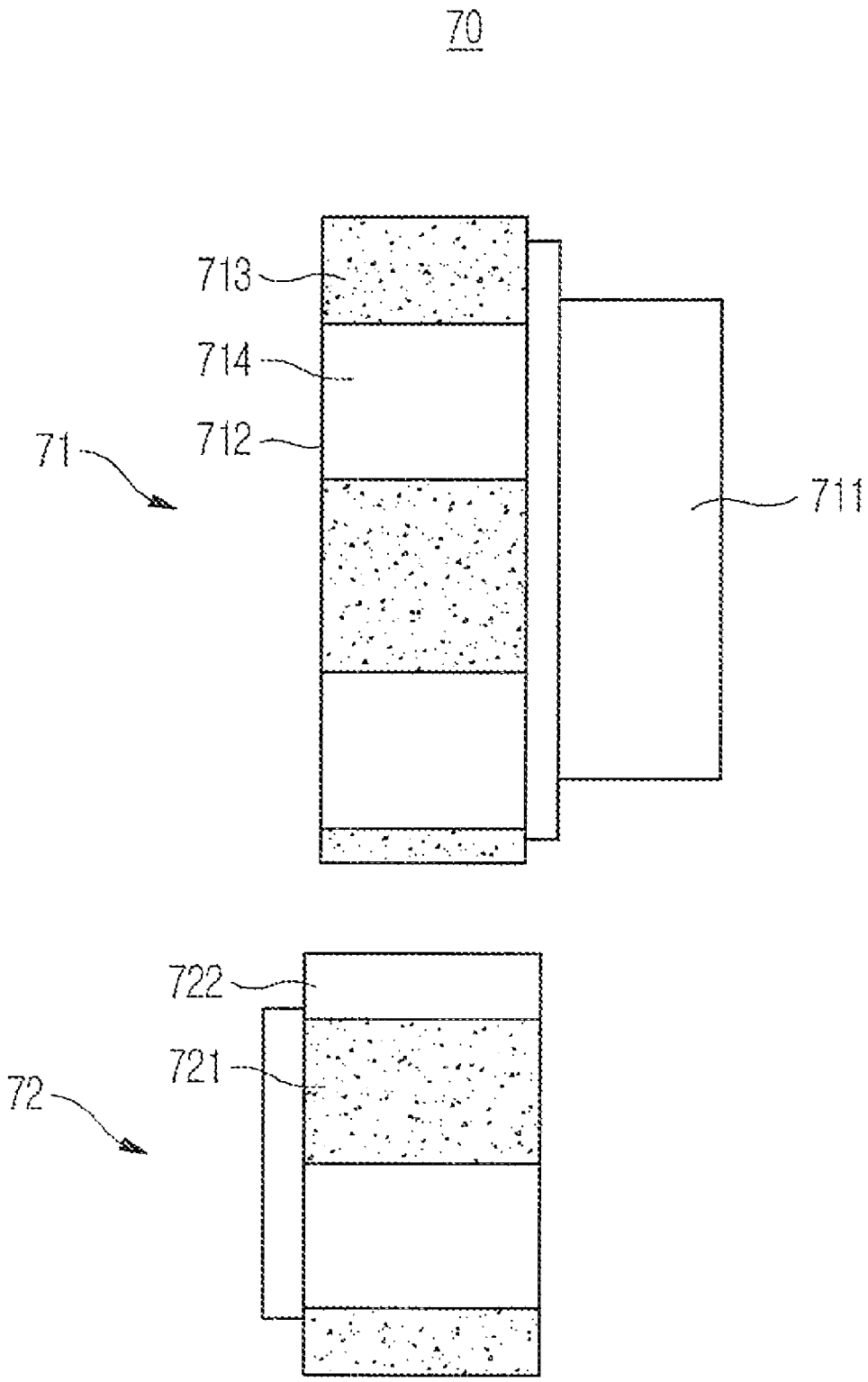
FIG. 4 is a side view of the power transmission device of FIG. 3.

Referring to FIGS. 3 and 4, the N pole magnets 713A-713F and 721A-721F, and the S pole magnets 714A-714F and 722A-722F are collectively referred as the N pole magnets 713 and 721 and the S pole magnets 714 and 722, respectively. The N pole magnets 713 and 721 and the S pole magnets 714 and 722 may be respectively arranged alternatingly on the outer circumferential surfaces of the first rotary body 71 and the second rotary body 72 such that the rotary force may be transmitted from the first rotary body 71 to the second rotary body 72 through a magnetic force. That is, the N pole magnets 713 and the S pole magnets 714 of the first rotary body 71 are alternatingly arranged on the power transmission part 712 of the first rotary body 71. The rotary force of the first rotary body 71 may thus be transmitted to the second rotary body 72 according to the attracting and repulsive forces between the N pole magnets 713 and the S pole magnets 714 of the first rotary body 71 and the N pole magnets 721 and the S pole magnets 722 of the second rotary body 72.

For purposes of illustration, shown in the following Table 1 is a summary of the result of a test conducted to determined whether the rotational power is transmitted under several test conditions of various rotating speeds of the first rotary body 71 and various weights of the rotary member coupled to the second rotary body 72. In Table 1 below, O indicates that the rotational power was observed while X indicates no power transmission was observed.

TABLE 1

| Rotational Speed | Weight of Rotary Member | Power Transmission | Remarks |
|---|---|---|---|
| 800 RPM | 50 g | ○ | Magnetic Force: 1,200 G |
| 900 RPM | 50 g | ○ | Diameter of First Rotary |
| 1,000 RPM | 50 g | ○ | Body: 18 mm |
| 1,100 RPM | 50 g | X | Diameter of Second Rotary |
| 1,100 RPM | 40 g | X | Body: 18 mm |
| 1,100 RPM | 30 g | X | Number of Magnets Disposed |
| 1,100 RPM | 20 g | ○ | on Each Rotary Body: 20 |

Again, for purposes of illustration, shown in the following Table 2 is a summary of the result of another test conducted to determined whether or not the rotational power is transmitted under several test conditions of various different weights of the scatter prevention member (i.e., the rotary member) and magnetic force and number of the magnets. Again, O indicates that the rotational power was observed while indicates X no power transmission was observed.

TABLE 2

| Magnetic Force | Weight of Rotary Member | Number of Magnets | Power Transmission | Remarks |
|---|---|---|---|---|
| 1,200 G | 50 g | 20 | ○ | Rotating Speed: |
| 1,200 G | 70 g | 20 | ○ | 800 RPM |

TABLE 2-continued

| Magnetic Force | Weight of Rotary Member | Number of Magnets | Power Transmission | Remarks |
|---|---|---|---|---|
| 1,200 G | 90 g | 20 | ○ | Diameter of First |
| 1,200 G | 110 g | 20 | ○ | Rotary Body: 18 mm |
| 1,200 G | 130 g | 20 | ○ | Diameter of Second |
| 1,200 G | 150 g | 20 | ○ | Rotary Body: 18 mm |
| 1,200 G | 170 g | 20 | X | |
| 3,000 G | 170 g | 10 | ○ | |
| 3,000 G | 250 g | 10 | ○ | |
| 3,000 G | 300 g | 10 | X | |

As can be observed from the above Tables 1 and 2, the larger the magnetic force of the magnets 713, 714, 721 and 722, the lighter the weight of the rotary member connected to the second rotary body 72, the slower the rotating speed of the first rotary body 71, the easier it is to transmit the rotary force from the first rotary body 71 to the second rotary body 72. Further, it can be observed that, when the diameters of the first and second rotary bodies 71 and 72 are equal, the smaller the number of the magnets disposed on each of the first and second rotary bodies 71 and 72, the easier it is for the rotary force of the first rotary body 71 to be transmitted to the second rotary body 72. The rotating speed of the first rotary body 71, the magnetic force of the magnets 713, 714, 721 and 722, and the number of the magnets 713, 714, 721 and 722 suitable for a particular design and/or application may be determined taking into consideration factors such as, for example, the weight and the rotating speed of the second rotary body 72, analytically or empirically.

Figure 5:
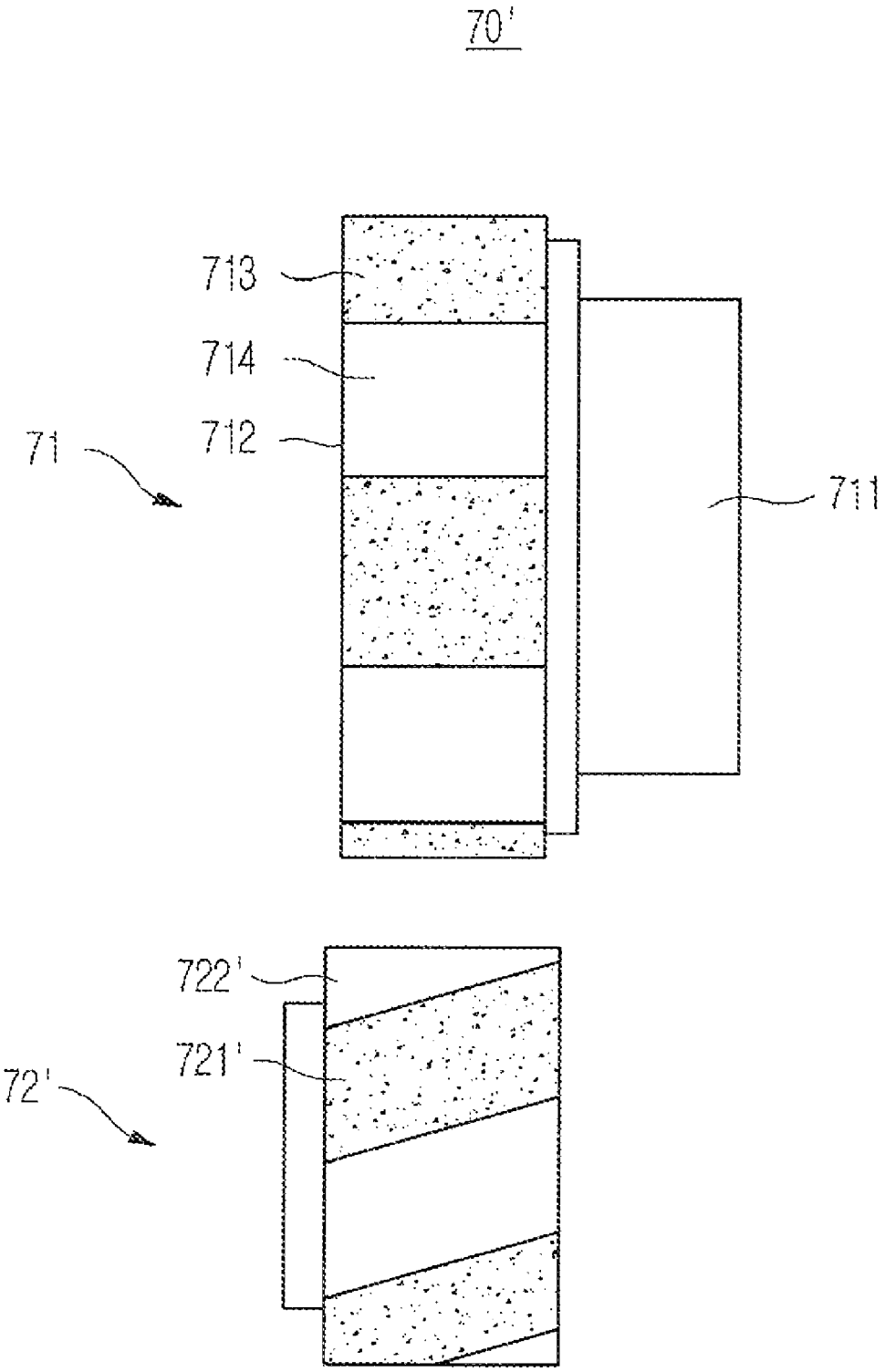
FIGS. 5 and 6 are side views of power transmission devices according to alternative embodiments of the present disclosure.

While in FIG. 4, the boundary lines between the N pole magnets 713 and 721 and the S pole magnets 714 and 722 are shown parallel to the respective rotation axis of the first and second rotary bodies 71 and 72, the boundary lines need not be so limited. For example, in the power transmission device 70' according to an alternative embodiment, as shown in FIG. 5, the boundary lines between the N pole magnets 721' and the S pole magnets 722' of the second rotary body 72' may be slanted at an angle with respect to the rotational axis. Such slanted boundary lines configuration may allow a variation of the magnetic force between the first rotary body 71 and the second rotary body 72', may allow the relative rotational speeds to change accordingly, for example, a slower rotation of the second body 72', and may thus allow a further reduction in the vibration generated during the power transmission process through the first rotary body 71 and the second rotary body 72'.

Figure 6:
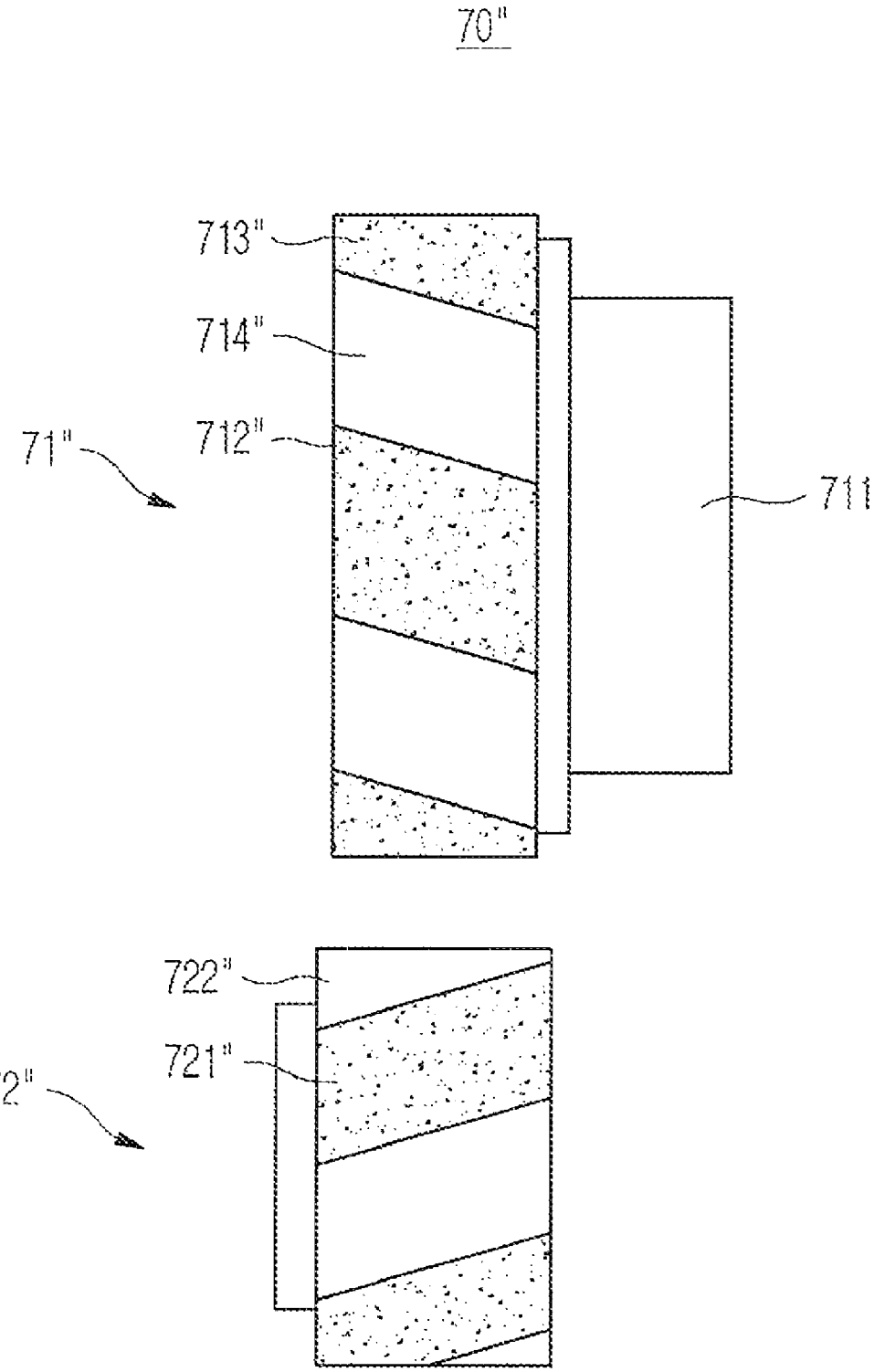

In the power transmission device 70" according to another alternative embodiment, as shown in FIG. 6, the boundary lines between the N pole magnets 713" and the S pole magnets 714" of the power transmission part 712" in the first rotary body 71" and the boundary lines between the N pole magnets 721" and the S pole magnets 722" of the second rotary body 72" may each be tilted with respect to the respective rotational axes.

While for purposes of illustrative convenience, various embodiments of the power transmission device 70 (70' and 70") are described in reference to the transmission of the rotary force to the scatter prevention member 35 as an example of a rotary member, it should be understood that the power transmission device according to one or more aspects of the present disclosure may be useful in transmission of the rotary force to any other in any number of the rotary members, for example, including but not limited to, one or more of the photoconductor 31, the charging roller 32, the developing body 33, the supply roller 34, the scatter prevention member 35, the feed rollers 12 and the transfer roller 13, or any other rotary member, for which the prevention of vibration thereof from being transferred to another member is desirable.

As would be apparent from the above description, the image forming apparatus in accordance with one or more aspects of the present disclosure may advantageously transmit a rotary force to one or more rotary members in a non-contact manner, thus avoiding the undesirable transmission of vibration through the power transmission device from one rotary member to another, and thus avoiding the adverse impact on the image quality attendant such transmission of vibration.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a rotary member rotatably arranged in the image forming apparatus; and a power transmission device coupled to the rotary member, the power transmission device being configured to receive a rotary force from a rotary force source and to transmit the received rotary force to the rotary member in a non-contact manner, the power transmission device including:

a first rotary body to rotate by the rotary force and including N-pole magnets and S-pole magnets, each N-pole magnet and each S-pole magnet arranged alternately with each other on an outer circumferential surface of the first rotary body in a circumferential direction of the first rotary body; and a second rotary body spaced apart from the first rotary body and including N-pole magnets and S-pole magnets, each N-pole magnet and each S-pole magnet arranged alternately with each other on an outer circumferential surface of the second rotary body in a circumferential direction of the second rotary body.

2. The image forming apparatus according to claim 1, wherein the rotary member comprises at least one selected from the group consisting of a photoconductor configured to carry thereon a visible image, a charging device configured to charge the photoconductor, a developing body configured to supply developer to the photoconductor to thereby form the visible image on the photoconductor, a supply device configured to supply the developer to the developing body and a scatter prevention member arranged to oppose and to be spaced apart from the photoconductor and configured to produce an air current in a first direction opposite to a second direction of air current produced by the photoconductor.

3. The image forming apparatus according to claim 1, wherein the first rotary body is rotated by the rotary force received from a driving motor, the second rotary body is rotatable by the rotary force transmitted from the first, rotary body in the non-contact manner.

4. The image forming apparatus according to claim 3, wherein first rotary body includes a gear part through which to receive the rotary force from the driving motor and a power transmission part configured to transmit the received rotary force to the second rotary body in the non-contact manner.

5. The image forming apparatus according to claim 3, wherein the second rotary body is rotated by the rotary force transmitted from the first rotary body through magnetic force.

6. The image forming apparatus according to claim 1, wherein one or more boundary lines between the N-pole magnets and the S-pole magnets are tilted at an angle with respect to rotational axes of the first rotary body and the second rotary body.

7. An image forming apparatus, comprising:

a photoconductor configured to carry thereon a visible image;

a rotary member rotatably arranged in the image forming apparatus, the rotary member comprising a scatter prevention member arranged to oppose and to be spaced apart from the photoconductor and configured to produce an air current in a first direction opposite to a second direction of air current produced by the photoconductor; and a power transmission device coupled to the rotary member, the power transmission device being configured to receive a rotary force from a rotary force source and to transmit the received rotary force to the rotary member through a magnetic force.

8. The image forming apparatus according to claim 7, wherein the power transmission device includes a first rotary body rotated by the rotary force received from a driving motor and a second rotary body spaced apart from the first rotary body, the second body being rotatable by the rotary force transmitted from the first rotary body through the magnetic force, the second body being coupled to the rotary member so as to rotate the rotary member.

9. The image forming apparatus according to claim 8, wherein N-pole magnets and S-pole magnets are arranged alternately on the first and second outer circumferential surfaces of the first rotary body and the second rotary body.

10. The image forming apparatus according to claim 9, wherein one or more boundary lines between the N-pole magnets and the S-pole magnets are tilted at an angle with respect to rotational axes of the first rotary body and the second rotary body.

11. The image forming apparatus of claim 8, wherein the first rotary body comprises a gear in engagement with the rotary force.

* * * * *